US011761262B2

(12) United States Patent
Fleischmann et al.

(10) Patent No.: US 11,761,262 B2
(45) Date of Patent: Sep. 19, 2023

(54) METHOD, SYSTEM AND APPARATUS FOR CONTROLLING EXCESSIVE GAPS OF A DOOR BOTTOM

(71) Applicant: National Guard Products, Inc., Memphis, TN (US)

(72) Inventors: Aron Fleischmann, Huxley, IA (US); Edwin R. Olivera, Collierville, TN (US)

(73) Assignee: NATIONAL GUARD PRODUCTS, INC., Memphis, TN (US)

( * ) Notice: Subject to any disclaimer, the term of this patent is extended or adjusted under 35 U.S.C. 154(b) by 0 days.

(21) Appl. No.: 17/735,652

(22) Filed: May 3, 2022

(65) Prior Publication Data

US 2022/0349244 A1 Nov. 3, 2022

Related U.S. Application Data

(60) Provisional application No. 63/183,220, filed on May 3, 2021.

(51) Int. Cl.
*E06B 7/232* (2006.01)
*E06B 7/18* (2006.01)

(52) U.S. Cl.
CPC ..... *E06B 7/232* (2013.01); *E06B 7/18* (2013.01)

(58) Field of Classification Search
CPC ..... E06B 7/232; E06B 7/18; E06B 7/2316
See application file for complete search history.

(56) References Cited

U.S. PATENT DOCUMENTS

| | | | | |
|---|---|---|---|---|
| 11,118,395 | B2 * | 9/2021 | Dintheer | E06B 3/46 |
| 11,261,653 | B2 * | 3/2022 | Skold, Jr. | E06B 7/2316 |
| 11,274,490 | B2 * | 3/2022 | Goldfinch | E06B 7/2316 |
| 2014/0047785 | A1 * | 2/2014 | Wilkinson | E06B 5/161 52/232 |
| 2018/0291674 | A1 * | 10/2018 | Dintheer | E06B 7/18 |
| 2019/0145158 | A1 * | 5/2019 | Powell | E06B 7/215 49/469 |
| 2019/0284874 | A1 * | 9/2019 | Healam | E06B 9/17046 |

* cited by examiner

*Primary Examiner* — Janet M Wilkens
*Assistant Examiner* — Susan M. Heschel
(74) *Attorney, Agent, or Firm* — K&L Gates LLP; Shu Chen

(57) ABSTRACT

A method, system and apparatus configured to correct a non-compliant, excessive gap condition between a door bottom and a finished floor. One example system may include a channel assembly attached to the bottom edge of the door, wherein the channel assembly includes at least one moving component configured to accommodate uneven door bottom gaps across the width of the door and an uneven floor condition.

16 Claims, 11 Drawing Sheets

METHOD, SYSTEM AND APPARATUS FOR CONTROLLING EXCESSIVE GAPS OF A DOOR BOTTOM

CROSS-REFERENCE TO RELATED APPLICATION

This application claims priority to U.S. Provisional Patent Application No. 63/183,220, filed May 3, 2021, the contents of which are herein incorporated by reference.

TECHNICAL FIELD

The present disclosure generally relates to a method, system and apparatus for controlling excessive gaps around the perimeter of a door, and more particularly relates to controlling and managing door bottom clearance for fire-rated door assemblies.

BACKGROUND

Fire-rated doors may be generally constructed of materials that work together to slow or stop the spread of flames, smoke and, in certain applications, radiant and conductive heat transfer. Common materials of fire-rated doors may include wood, steel, fiberglass and fire-rated glass, or a combination of these materials. Structurally, a fire-rated door assembly may generally contain a frame, door(s), hardware, glazing, smoke seal gasket, and/or component parts. In application, fire-rated doors work in conjunction with surrounding passive fire protection systems to provide around-the-clock defense against fire and enable safe and unobstructed passage out of a building. When installed properly, the fire-rated doors will not combust or fail for the duration of their corresponding fire rating (in the average fire). Standard fire ratings vary, typically ranging from 20 to 180 minutes depending on code criteria. Fire-rated doors are required to be self-closing and positive latching, and must remain closed during a fire to protect the means of egress. Fire-rated door assemblies must comply with code requirements set forth by the National Fire Protection Association (NFPA), in particular, NFPA 101, Life Safety Code and NFPA 80, Standard for Fire Doors and Other Opening Protectives. These codes cover the installation, care and maintenance of many types of fire-rated doors and openings (i.e., assemblies). Specifically, NFPA 80 requires that all fire-rated door assemblies be inspected and tested annually. Facility managers may be responsible for ensuring that the annual inspection, testing, and record-keeping is performed. Any deficiencies must be corrected and documented, with follow-up acceptance by inspection and testing as per the authority having jurisdiction, in accordance with NFPA 80.

Generally, the inspection and testing may include the following 11 items: no open holes or breaks present on the surfaces of a fire-rated door assembly; glazing is intact and in place; doors, frames and hardware of the fire-rated door assembly are secured and in working order; parts are not missing or broken; door clearances are within required specifications; self-closing devices are operational; door coordinator (if installed) functions correctly; latching hardware secures the door when it is closed; auxiliary hardware does not interfere with the door or frame of the fire-rated door assembly; field modifications have not been made that void the label which indicates critical information about the original construction of the fire-rated door assembly, from its manufacturer and fire rating to whether it carries a temperature-rise rating; and gasketing and seals are in place, where required. Perimeter gaps in fire-rated door assemblies may refer to the distance between one edge of a fire-rated door and the door frame as measured from one side of the opening of the door (e.g., pull side). Door bottom gaps may refer to the distance between the bottom of the door and the finished floor.

In one example, NFPA 80 sets the maximum allowable perimeter gap to ⅛" for wood doors and ⅛"+/−1/16" for metal doors. Maximum allowable gap at the door bottom is ¾". These requirements relate to both single swing and double swing (pair) door conditions. Door gaps that exceed these maximum allowable tolerances result in a non-compliant fire-rated door assembly that needs to be corrected, inspected, and approved to maintain compliance. That is, proper gap tolerances ensure that a fire-rated door assembly will perform as it is intended. Gaps that are outside of tolerance may lead to compromised fire-rated door assembly integrity in a fire situation as well as not allowing the fire door latching mechanism to engage fully as it is required to do so by relevant regulation codes.

One prior art reference U.S. Pat. No. 9,273,510 B2 generally relates to fire-rated door non-compliance issues due to excessive gaps. This patent solves this problem by using a door stop extension to cause a correction of a non-compliance of a pre-existing door system with NFPA 80. Specifically, the patent discloses the issues with fire-rated door assemblies having excessive clearance gaps between the edges of doors and the frames. Excessive clearance gaps reduce the effectiveness of the door stops that are integral to the frames. The greater the clearance between the door and the frame, the less the door stops are able to maintain the fire-rating of the door assembly. While this patent addresses the issue related to the excessive gap between the door and the frame, it does not address the excessive gap at the bottom of the door.

Therefore, there is a need for controlling and managing door bottom clearance(s) of various door assemblies (e.g., a single door or double swing doors) for tire safety purposes.

SUMMARY

Among other features, the present disclosure relates to a method and apparatus configured to provide a solution to control the clearance between the bottom of a door and a finished floor. In one aspect, the door bottom solution disclosed in the present disclosure may be configured to accommodate clearance dimensions which vary between the bottom of the door and finished floor, across the width of the door. Moreover, the present disclosure may be configured to accommodate uneven locations of a finished floor which may create an interference between the door bottom and the finished floor during the swing path of the door. Additionally, the present disclosure may be configured to accommodate the installation preference to modify door bottom clearance without attaching additional components to either face of the door.

The above-simplified summary of example aspects serves to provide a basic understanding of the present disclosure. This summary is not an extensive overview of all contemplated aspects, and is intended to neither identify key or critical elements of all aspects nor delineate the scope of any or all aspects of the present disclosure. Its sole purpose is to present one or more aspects in a simplified form as a prelude to the more detailed description of the disclosure that follows. To the accomplishment of the foregoing, the one or more aspects of the present disclosure include the features described and exemplary pointed out in the claims.

BRIEF DESCRIPTIONS OF THE DRAWINGS

The accompanying drawings, which are incorporated into and constitute a part of this specification, illustrate one or more example aspects of the present disclosure and, together with the detailed description, serve to explain their principles and implementations.

Figure 7A:
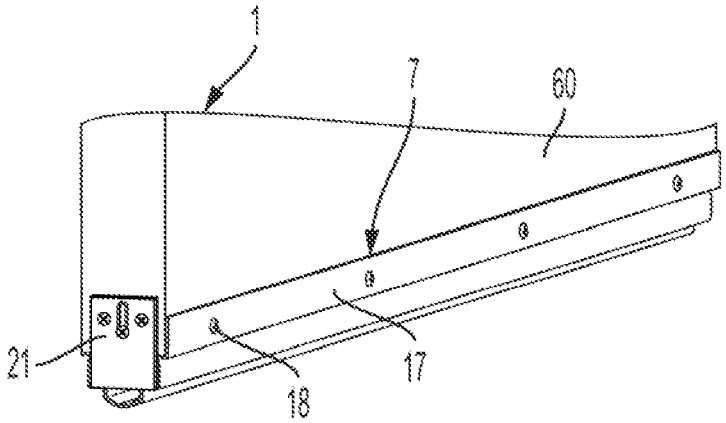
Figure 7B:
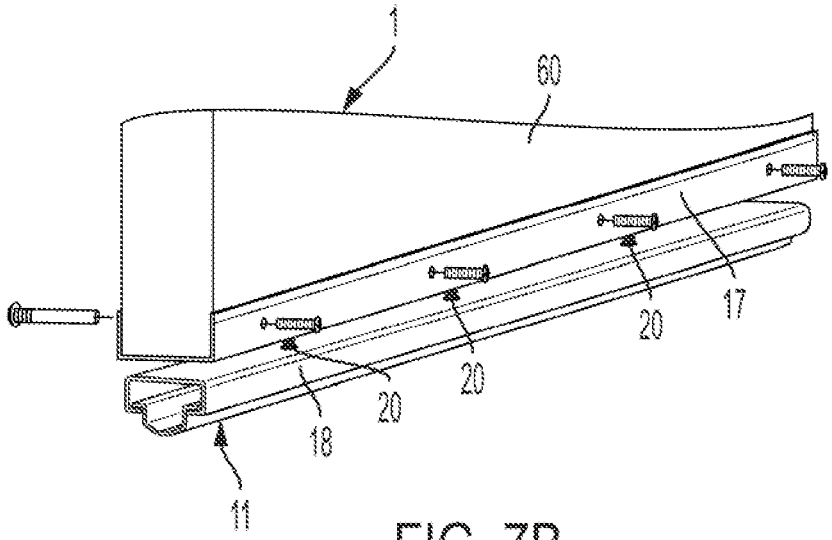
Figure 7C:
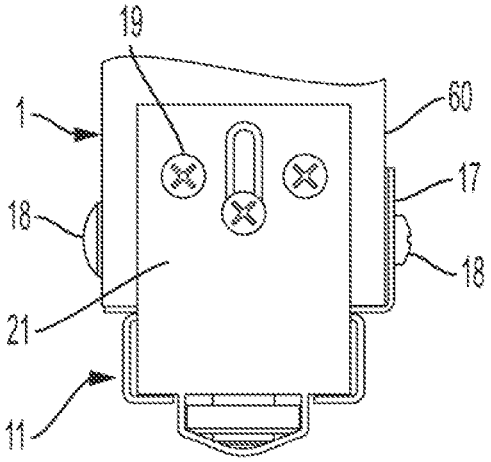
Figure 8A:
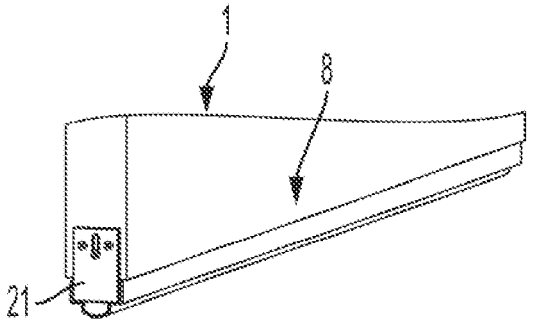
Figure 8B:
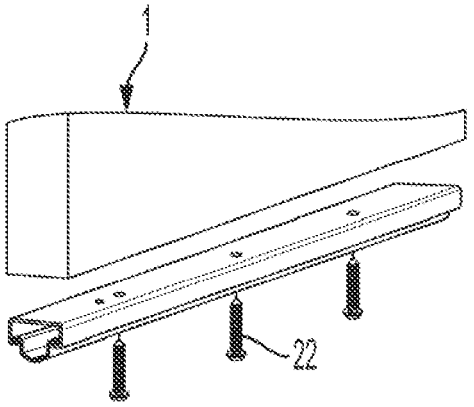
Figure 8C:
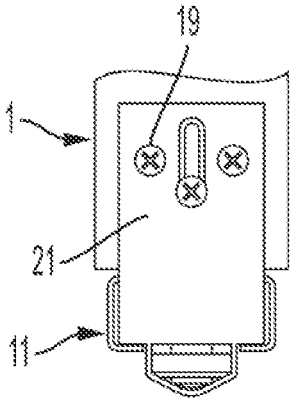
Figure 11:
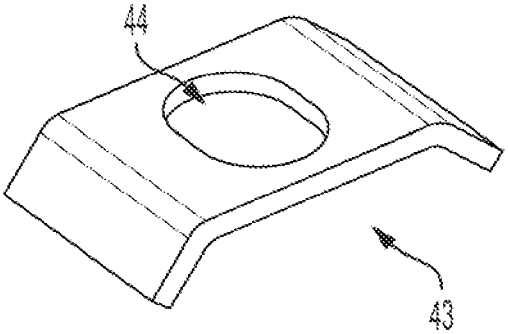
Figure 12A:
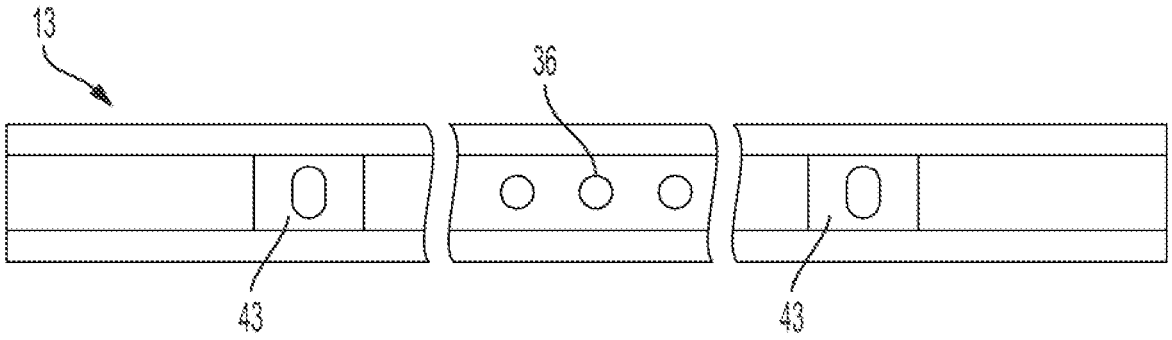
Figure 12B:
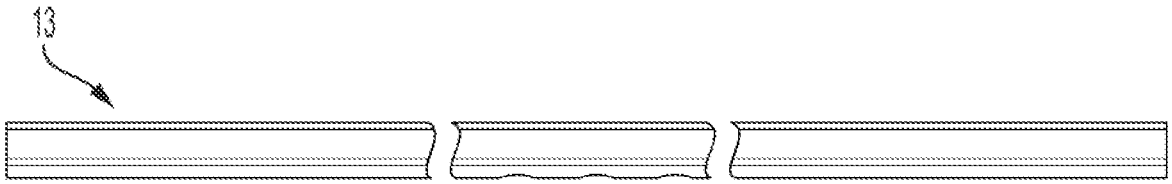
Figure 12C:
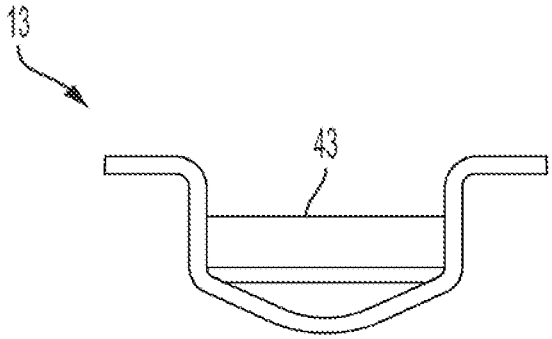
Figure 13A:
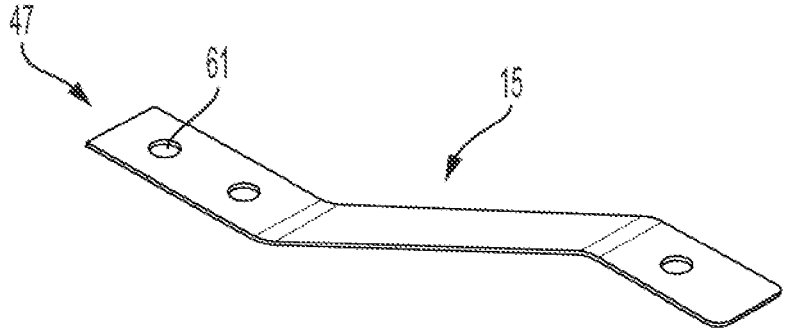
Figure 13B:
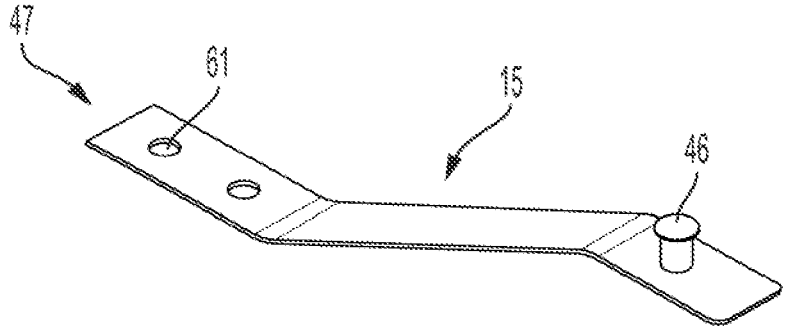
Figure 14A:
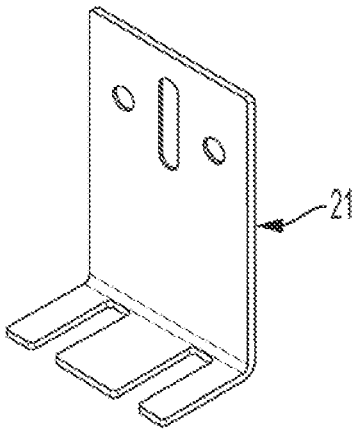
Figure 14B:
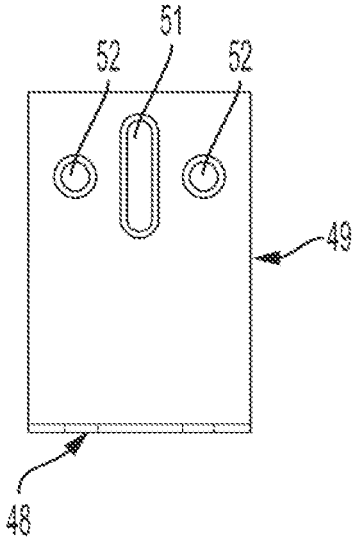
Figure 14C:
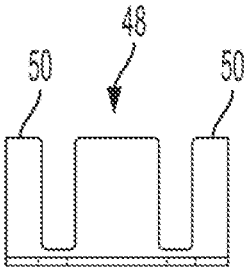
Figure 14D:
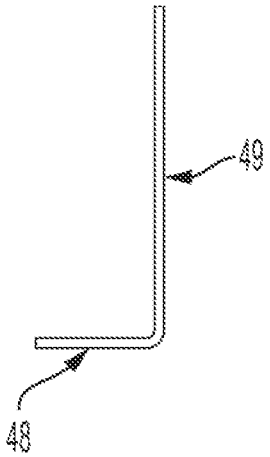

FIGS. 7A, 7B, and 7C illustrate multiple perspective views of a channel assembly including an L-shaped bracket and end caps assembled onto a door for controlling or managing a door bottom clearance, according to an exemplary aspect of the present disclosure;

FIGS. 8A, 8B, and 8C illustrate multiple perspective views of a channel assembly including end caps assembled onto a door for controlling or managing a door bottom clearance, according to an exemplary aspect of the present disclosure;

FIGS. 9A, 9B, 9C, and 9D illustrate multiple perspective views of a top channel of a channel assembly, according to an exemplary aspect of the present disclosure;

FIGS. 10A, 10B, 10C, and 10D illustrate multiple perspective views of a V-shaped bottom channel of a channel assembly, according to an exemplary aspect of the present disclosure;

FIG. 11 illustrates a spring receiver, according to an exemplary aspect of the present disclosure;

FIGS. 12A, 12B, and 12C illustrate multiple perspective views of a V-shaped bottom channel in relation to a spring receiver, according to an exemplary aspect of the present disclosure;

FIGS. 13A and 13B illustrate two perspective views of a formed spring, according to an exemplary aspect of the present disclosure;

FIGS. 14A, 14B, 14C, and 14D illustrate multiple perspective views of an end cap, according to an exemplary aspect of the present disclosure; and FIGS. 15A, 15B, 15C, and 15D illustrate multiple perspective views of an L-shaped bracket, according to an exemplary aspect of the present disclosure.

DETAILED DESCRIPTION

Various aspects of the present disclosure will be described with reference to the drawings, wherein like reference numerals are used to refer to like elements throughout. In the following description, for purposes of explanation, numerous specific details are set forth in order to promote a thorough understanding of one or more aspects of the present application. It may be evident in some or all instances, however, that any aspects described below can be practiced without adopting the specific design details described below.

As will be described fully below, the present disclosure may be configured to correct a door bottom gap by inserting e.g., a channel assembly into a gap between the bottom edge of a door and a finished floor beneath the door, and attaching the channel assembly to the bottom edge of the door. In so doing, the present disclosure may extend the height of the door, thereby reducing the gap at the bottom of the door. For example, if such a gap measures 1.375" across the width of the door, the channel assembly of the present disclosure, which may measure 1.0" in height, and upon installation to the bottom of the door, may add 1.0" to the effective height of the door and therefore reduce the door bottom gap to 0.375". The 0.375" dimension may be within the 0.75" dimension currently allowed by relevant regulation code for fire-rated doors.

In another embodiment, the present disclosure may be configured to control uneven door bottom gaps across the width of the door via at least one moving component of the channel assembly. In one aspect, the moving part may be set on a pre-determined location via one or more end caps, thereby dynamically changing the height of the channel assembly. If a door bottom gap measures 1.375" on one side of the door and 1.0" on the other, the end caps may be used to set the moving part on an angle, thereby accommodating the uneven floor condition. In all cases, the moving part may be free to move to accommodate high spots or other obstructions encountered during the swinging motion path of the door during operation.

In accordance with important aspects of the present disclosure, the moving component of the channel assembly may be configured to provide a selected height ranging from a maximum (across the width of the door) of 1" (full extension condition) and a minimum (across the width of the door) of 0.625" (full compression condition). As will be described fully below, an example channel assembly of the present disclosure may include a top channel, a V-shaped bottom channel and a formed spring. The internal moving component may be the V-shaped bottom channel, and the configuration of the channel assembly may provide for a constrained motion path (travel distance) of the V-shaped bottom channel within the top channel. The formed spring, which connects the top channel to the V-shaped bottom channel, may be configured to apply a downward force onto the V-shaped bottom channel, yet allow the V-shaped bottom channel to operate within a motion path as allowed for by the respective parts' geometry. That is, the channel assembly of the present disclosure provides a motion path for the V-shaped bottom channel to freely operate in a substantially vertical motion path, or alternatively one that may be at an angle. As a result, the motion path may be configured to accommodate either a gap that is uniform across the width of a door, or a gap that varies from one side of the door to the other.

In one embodiment, to provide a pre-set height location from one side of the door to the other (other than that of full extension of the channel assembly), one or more end caps may be used in addition to the channel assembly. For example, each end cap may be generally L-shaped with one vertical portion installed on the outer surface of a door edge and the horizontal portion inserted into the space between the top channel and the V-shaped bottom channel. Each end cap may be used to retain the V-shaped bottom channel at a fixed position relative to a gap between its horizontal portion and the finished floor. As discussed above, door bottom gap dimension may be uniform or inconsistent across the width of the door. When the end caps are used and the pre-set height is greater than the minimum (full compression state of the formed spring) height of the channel assembly, the V-shaped bottom channel may be allowed to move within the top channel. The motion path of the V-shaped bottom channel may also provide a means of clearance (temporarily reducing the effective height of the channel assembly), should the V-shaped bottom channel make contact with a high spot in the finished floor. When a high spot or obstruction is encountered, the V-shaped bottom channel may move to a position within the top channel, until the moment that the high spot is no longer present (during a swing operation of the door), then the V-shaped bottom channel returns to the pre-set height location, due to the downward force applied by the formed spring.

Among other features, the present disclosure may include a fire-rated door assembly which may contain a listed and labeled fire rated frame, a listed and labeled fire rated single-swing door and a listed and labeled tire rated smoke seal gasket set. It is known in the art that excessive clearance gaps around the perimeter of the door may be brought into compliance by using a stop extender, attached to the frame. However, there is a need for a different solution when an assembly contains a door that is compliant around the perimeter but non-compliant at the door bottom.

Regarding the gap at the door bottom, a few elements factor into the effectiveness of the disclosed method and apparatus. First, the gap between the door bottom and the finished floor is often not a consistent dimension across the width of the door. Second, the finished floor condition is often not consistent and there may exist high spots in the finished floor which may reduce the gap dimension at a particular location in the swinging action of the door. Furthermore, the listed and labeled fire rated doors may be wood-composite (commonly containing a mineral-based core) or a hollow metal, steel door. The disclosed method and apparatus may account for these variations while providing for an aesthetic and practical solution.

Figure 1:
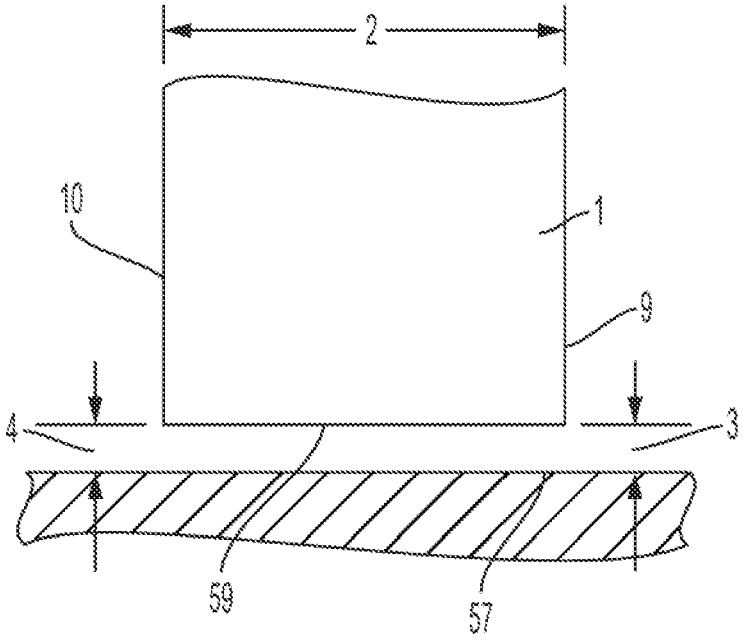
FIG. 1 illustrates a first side view of a first gap condition between a bottom edge of a door and the finished floor.
Figure 2:
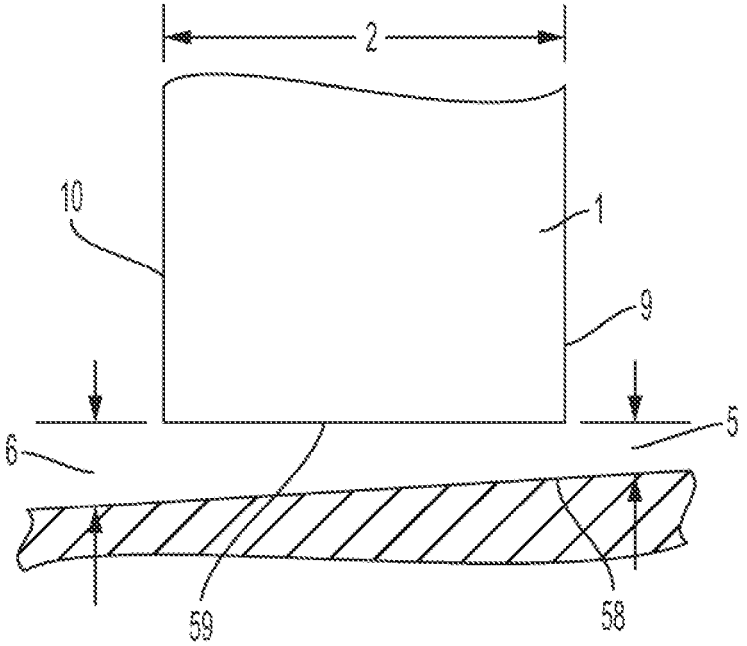
FIG. 2 illustrates a second side view of a second gap condition between a bottom edge of a door and the finished floor.

FIG. 1 demonstrates a first gap condition between the bottom edge 59 of door 1 and the finished floor 57, whereby gap 3 measured at one edge 9 of door 1 may be substantially the same as gap 4 measured at the other edge 10 of door 1. As such, the gap between the bottom edge 59 of door 1 and finished floor 57 may be uniform across the width dimension 2 of door 1 (e.g., commonly measured 36"). Referring to FIG. 2, a second gap condition may exist between the bottom edge 59 of door 1 and the finished floor 58, whereby the gap 5 measured at one edge 9 may be either greater or less than the gap 6 measured at the other edge 10 of door 1. As such, the gap between the bottom edge 59 of door 1 and finished floor 58 may not be uniform across the width 2 of door 1.

Figure 4:
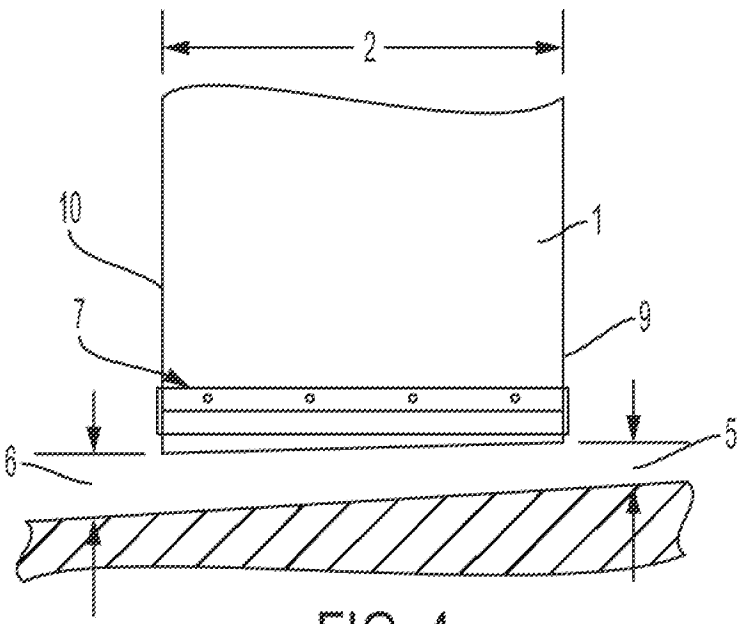
FIG. 4 illustrates a second assembly to a door using an L-shaped door bracket to correct the second gap condition of FIG. 2, according to an exemplary aspect of the present disclosure.
Figure 3:
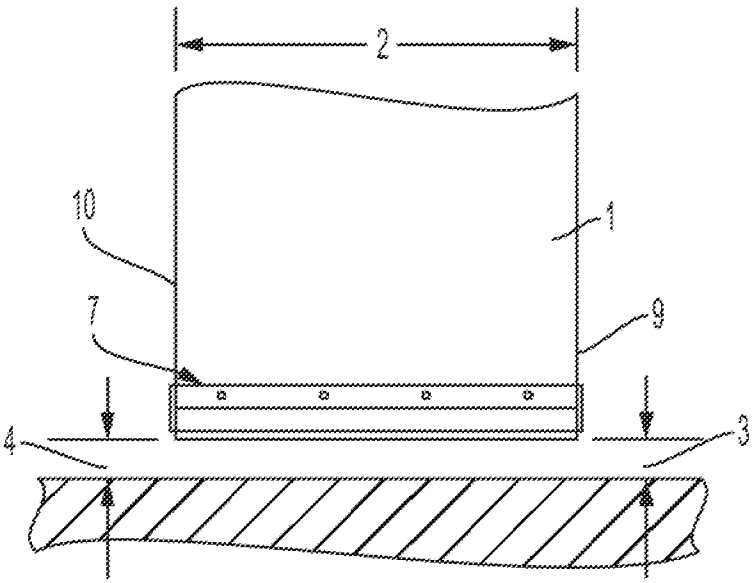
FIG. 3 illustrates a first assembly to a door using an L-shaped door bracket to correct the first gap condition of FIG. 1, according to an exemplary aspect of the present disclosure.

In one aspect, the present disclosure may be configured to provide a solution for the gap conditions illustrated in FIGS. 1 and 2. For example, referring to FIG. 3, one embodiment may include a door bottom assembly having an L-shaped bracket 7 installed onto the bottom portion of door 1, wherein the gap condition may be uniform across the width 2 of the door 1, as shown in FIG. 1. Further, referring to FIG. 4, another embodiment may include a door bottom assembly having an L-shaped bracket 7 installed onto the bottom portion of door 1, wherein the gap condition is not uniform across the width 2 of the door 1, as shown in FIG. 2. In one preferred embodiment, the present disclosure may provide a solution to account for 0.375" gap condition variance across the width 2 of the door 1. It should be appreciated that the installation of the L-bracket 7 on the door 1 may allow for the installation of the entire door bottom assembly of the present disclosure onto the bottom portion of the door 1 while the door 1 is hanging on its hinges. In certain implementations, the L-shaped bracket 7 may be optional where the door 1 may be taken down (off the hinges) so that access to the bottom edge of the door 1 is available to insert the fasteners or other attachment components.

Figure 6:
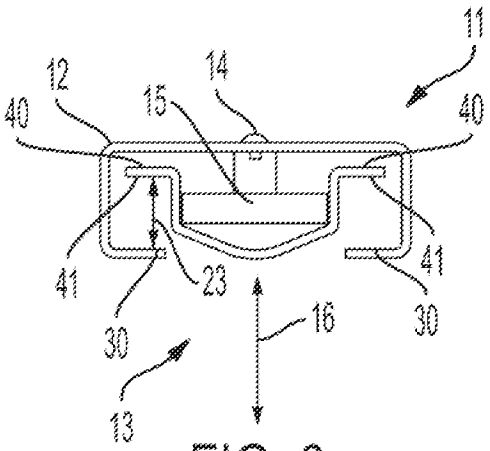
FIG. 6 illustrates a second side view of a channel assembly in a compressed position, according to an exemplary aspect of the present disclosure.
Figure 5:
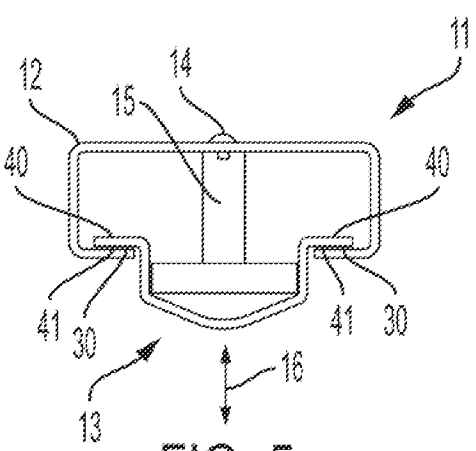
FIG. 5 illustrates a first side view of a channel assembly in a fully extended position, according to an exemplary aspect of the present disclosure.
Figure 9D:
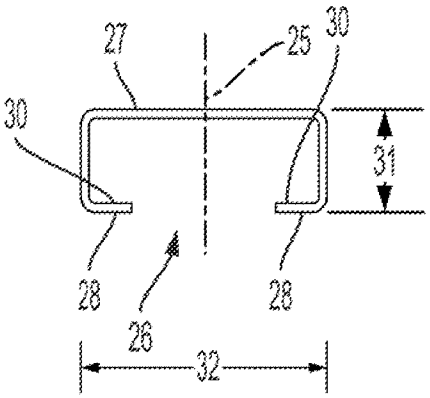
Figure 10A:
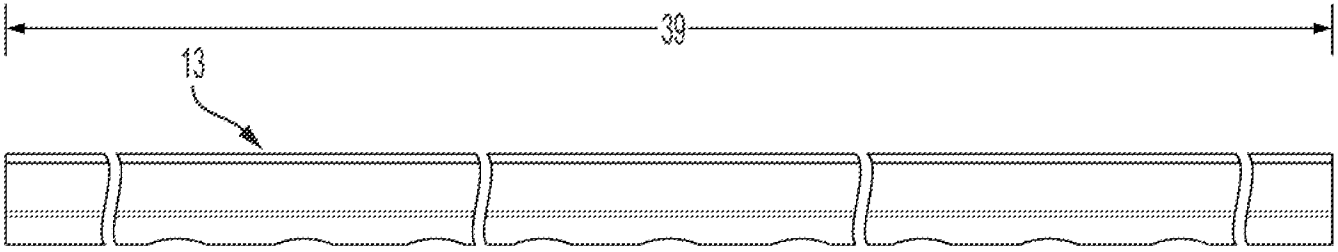
Figure 10B:
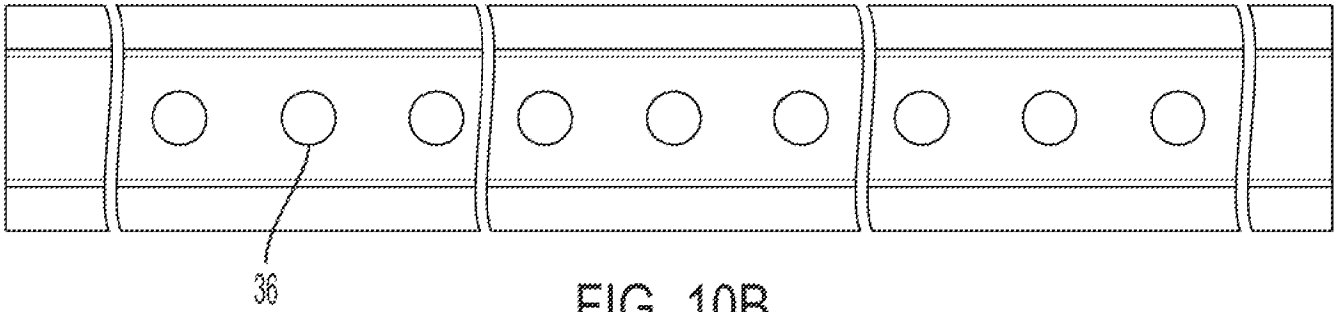
Figure 10C:
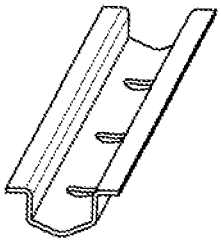
Figure 10D:
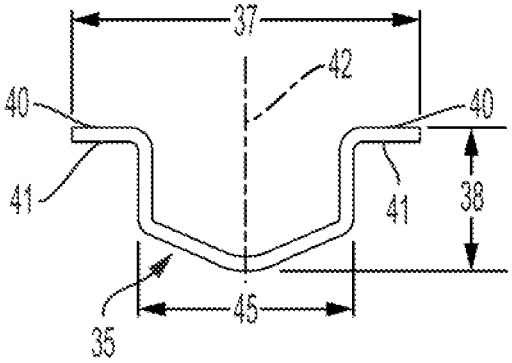

As will be described fully below, one example system for controlling or managing door bottom clearance for a fire-rated door may include a channel assembly 11, end caps 21 and an L-shaped bracket 17, in accordance with aspects of the present disclosure. Referring to FIG. 5, an example channel assembly 11 may include a top channel 12, a V-shaped bottom channel 13, and a formed spring 15 with its topmost end affixed to an underside of the top channel 12 by a rivet 14. As shown in FIGS. 5 and 6, the channel assembly 11 of the present disclosure may have a substantially vertical motion path 16, wherein the V-shaped bottom channel 13 may be fully or partially contained within the space defined by the top channel 12. FIG. 5 shows the channel assembly 11 in a fully extended position, wherein the bottom face 41 of each co-planar tab 40 of the V-shaped bottom channel 13 makes resting contact with the inside face 30 of the co-planar tab 28 of the top channel 12, as shown in FIGS. 9D and 10D. Referring to FIG. 6, the channel assembly 11 is shown to be in a fully compressed position, thereby resulting in a travel distance 23 of the V-shaped bottom channel 13 between the bottom face 41 and the inside face 30. That is, the V-shaped bottom channel 13 may be configured to move relative to the top channel 12 along a substantially vertical motion path 16 which may be controlled by a down pressure exerted onto the V-shaped bottom channel 13 by the formed spring 15. As shown in FIGS. 12C, 13A and 138, the formed spring 15 may be retained by the engagement of a protrusion 46 located on the formed spring 15, opposite the end 47, and captured within of opening 44 of spring receiver 43. The spring receiver 43 may be welded into the V-shaped bottom channel 13, as shown in FIGS. 12A and 12C, thus providing the retaining mechanism for the protrusion 46. FIG. 12B illustrates a side perspective view of the V-shaped bottom channel 13 with spring receivers 43 welded within. In one embodiment, as shown in FIG. 12A, two spring receivers 43 may be welded within the V-shaped bottom channel 13, each spaced at a distance of 4" from the respective ends of V-shaped bottom channel 13 in order to leave a distance or spacing between the two spring receivers 43 measuring 25.375". This spacing may provide for the spring action to be biased toward the outer edges of channel assembly 11, providing for the proper motion path 16 as previously described.

In an example implementation, the channel assembly 11 of the present disclosure may be configured to include the top channel 12 connected with the V-shaped bottom channel 13, via the formed spring 15. Initially, the formed spring 15 may be compressed, such that the end of the formed spring 15 containing the protrusion 46 may rest against the top channel 12. Subsequently, the V-shaped bottom channel 13 may be configured to move into the space defined by the top channel 12, such that the protrusion 46 aligns with the opening 44 of the spring receiver 43, as shown in FIG. 11. The compression on the formed spring 15 may be released allowing the protrusion 46 to rest securely within the opening 44 of the spring receiver 43.

Figure 15A:
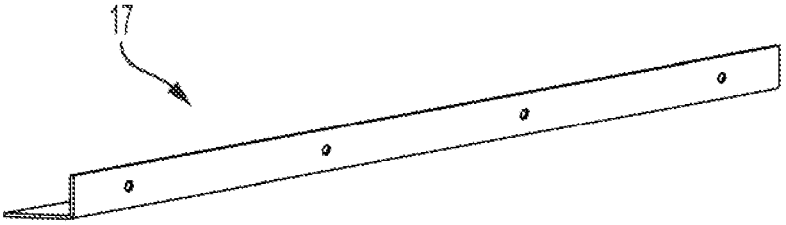
Figure 15B:
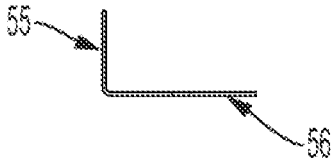
Figure 15C:
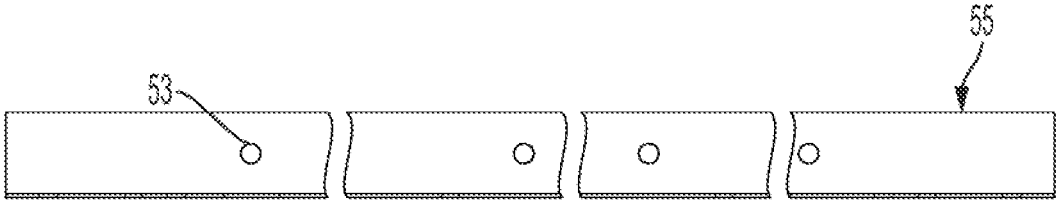
Figure 15D:
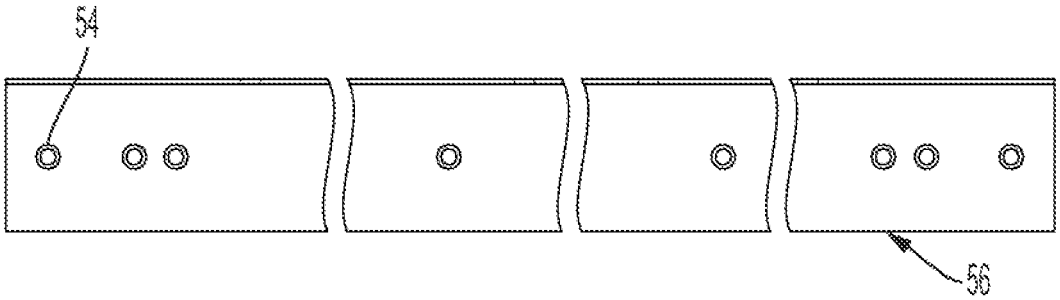

FIGS. 3, 4, 7A, 7B and 7C illustrate multiple perspective views of the channel assembly 11 including an L-shaped bracket 17 assembled onto a door 1 for controlling or managing door bottom clearance, in accordance with aspects of the present disclosure. Referring to FIG. 7B, the channel assembly 11 may be attached to the L-bracket 17 using one or more fasteners 20 inserted through one or more holes 54 which are located on a long leg 56 of L-bracket 17, as shown in FIGS. 15A, 15B, and 15D. Next, the channel assembly 11 may be positioned on the bottom edge 59 of the door 1 as shown in FIGS. 1 and 2, and the L-bracket 17 may be attached to a selected outer face 60 of the door 1 via fasteners 18 inserted through one or more holes 53 which are located on a short leg 55 of the L-shaped bracket 17, as shown in FIGS. 15A, 15B and 15C. In one embodiment, referring to FIG. 7A, two end caps 21 may be installed on two narrow ends of the door 1 (e.g., one on edge 9 and one on edge 10 of door 1, as shown in FIGS. 1-4). Referring to FIGS. 14A, 14B, 14C and 14D, each end cap 21 may be generally L-shaped including a vertical portion 49 placed on the outer surface of one narrow end of the door 1 and a horizontal portion 48 inserted into the space between the bottom edge of door 1 and the finished floor. In one embodiment, the horizontal portion 48 may be configured to include one or more tabs 50 that may be implemented and inserted into the space defined by the top channel 12, orthogonal to the travel distance 23 described in connection with FIG. 6, thereby controlling the amount of travel along the motion path 16 of the V-shaped bottom channel 13. As shown is FIGS. 7C and 14B, one or more fasteners 19 may be initially installed into slot 51 of each end cap 21 until a desired position is determined. Thereafter, fasteners 19 may be installed into corresponding through holes 52 of each end cap 21 for secure attachment to the edges of door 1.

Alternatively, another example system for controlling or managing door bottom clearance for a fire-rated door may include a channel assembly 11 and end caps 21, in accordance with aspects of the present disclosure. Referring to FIG. 8B, the channel assembly 11 may be initially positioned on the bottom edge 59 of the door 1, and one or more fasteners 22 may be inserted through slotted openings 29 of the top channel 12 of the channel assembly 11 to securely attach the channel assembly 11 on the bottom edge 59 of the door 1. Next, referring to FIG. 8A, two end caps 21 may be installed on two narrow ends of the door 1 (e.g., one on edge 9 and one on edge 10 of door 1, as shown in FIGS. 1-4). Referring to FIGS. 14A, 14B, 14C and 14D, each end cap 21 of this embodiment may be generally L-shaped including the vertical portion 49 placed on the outer surface of one narrow end of the door 1 and the horizontal portion 48 inserted into the space between the bottom edge of door 1 and the finished floor. For example, the horizontal portion 48 may include one or more tabs 50 inserted into the space defined by the top channel 12, orthogonal to the travel distance 23 described in connection with FIG. 6, thereby controlling the amount of travel along the motion path 16 of the V-shaped bottom channel 13. In one embodiment, each of tabs 50 may be sized to position between the co-planar tabs of the top channel 12 and the V-shaped bottom channel 13, and between the vertical walls (slabs) of the top channel 12 and the V-shaped bottom channel 13, respectively. As shown is FIGS. 8C and 14B, one or more fasteners 19 may be initially installed into slot 51 of each end cap 21 until a desired position is reached. Thereafter, fasteners 19 may be installed into corresponding through holes 52 of each end cap 21 for secure attachment to the edges of door 1.

In some alternative embodiments, the end caps 21 may be optional where a selected height may be desired other than that of a full extension of the V-shaped bottom channel 13. That is, the end caps may be used to set a pre-set height that may be different on one side of the door than the other. The pre-set height locations of the end caps on either side of the door may be independent of each other, and therefore may be used to position the V-shaped bottom channel 13 within the top channel 12, at a position that ranges from a maximum (full extension) on one side to a minimum (full compression), or any location therebetween. In certain implementations, the end caps 21 may accommodate high spots in the floor or other obstructions encountered during the swinging motion of the door. Importantly, the end caps 21 may be configured to provide a motion path of the V-shaped bottom channel 13 within the top channel 12 which allows for the option of different pre-set heights to be set, and allows for the V-shaped bottom channel 13 to be set at an angle (across the width of the door).

Figure 9A:
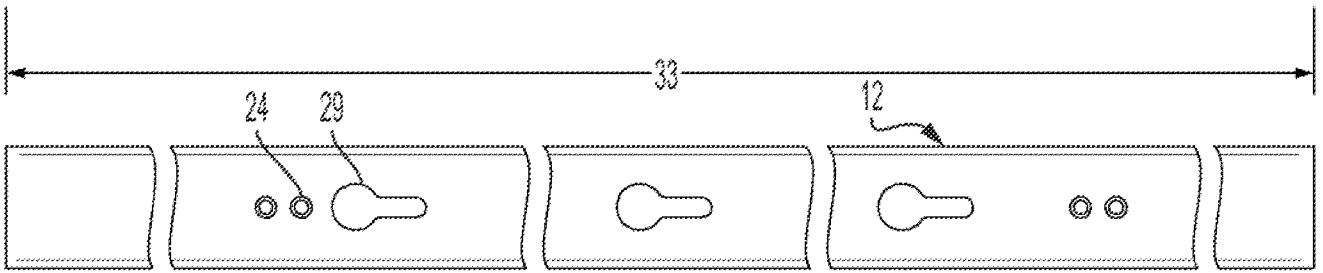
Figure 9B:
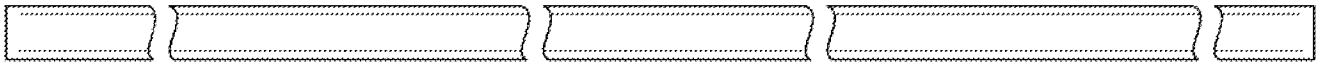
Figure 9C:
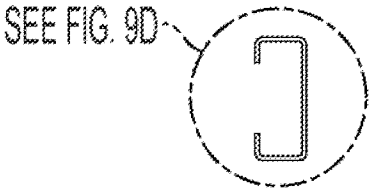
Figure 9C:
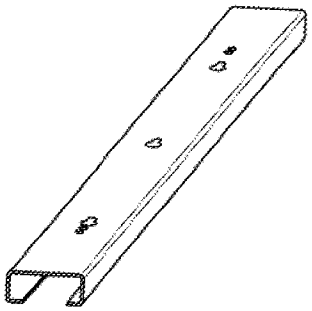

Referring now to FIGS. 9A, 9B and 9C, in one preferred embodiment, the top channel 12 of the channel assembly 11 of the present disclosure may be made of 18 gauge steel (e.g., 0.048" in thickness) and formed into a rectangular in shape, containing a width dimension 32 of 1.50" and a height dimension 31 of 0.625" and a length dimension 33 of 35.5". Referring to FIG. 9D, one of the widest top side 27 of the top channel 12 may include mounting multiple holes 24 and slotted openings 29, while the opposite side may include an open distance 26 which may measure 0.75" and may be located symmetrical about a centerline 25. The open distance 26 may result in two co-planar tabs 28, each including an inside face 30.

In accordance with aspects of the present disclosure, the V-shaped bottom channel 13 of the channel assembly 11 may be made of 18 gauge steel and formed into a symmetrical geometry about a centerline 42, as shown in FIG. 10D. In one embodiment, the V-shaped bottom channel 13 may include a V-shape portion 35 at the bottom and connected with two co-planar tabs 40 on both side of the centerline 42 via two vertical slabs, respectively. Each co-planar tab 40 may include a bottom face 41. In one embodiment, the width dimension 37 of the V-shaped bottom channel 13 may measure 1.375" and the width dimension 45 of the V-shape portion 35 may measure 0.625" and the overall length 39 of the V-shaped bottom channel 13 may measure 35.375". These width dimensions are critical to the interaction within the top channel 12 upon assembly into the channel assembly 11. In one preferred embodiment in connection with FIGS. 5 and 6, the width dimension 37 of V-shaped bottom 13 (1.375") may be less than the inside width of the top channel 12, created by subtracting twice the 18 gauge material thickness (2×0.048") from width 32 (1.50")=1.40". Additionally, as shown in FIG. 101), width dimension 45 (0.625") of the V-shaped portion 35 may be less than the open distance 26 (0.75") of the top channel 12. These dimensions provide for an unobstructed motion path of V-shaped bottom channel 13 within the top channel 12, controlled by spring 15. Moreover, the height 38 of the channel assembly 11 may measure 0.375" which may be critical to the interaction within the top channel 12 as this dimension may control the travel distance 23, which measures 0.375". Lastly, as shown in FIGS. 10B and 10C, a plurality of through holes 36 (e.g., each may measure 0.3125" in diameter) may be located along the centerline 42 on the V-shaped portion 35. Referring to FIG. 11, the spring receiver 43 may be made of 18 gauge steel and measure 1" in length and the width is matched to the inside dimension of the V-shaped portion 35 of the V-shaped bottom channel 13. The opening 44 may be a slot which measures 0.25"×0.4375". Referring to FIGS. 13A and 13B, the formed spring 15 may be made from 0.03" thick spring steel, measuring 0.375" wide and formed with two bends, resulting in two parallel ends. In one embodiment, one end 47 may include two through holes 61 which are 0.125" in diameter, and the opposite end may include a protrusion 46 which measures 0.125" diameter and 0.25" in height. Referring to FIGS. 14A, 14B, 14C and 14D, each end cap 21 may be formed from 16 gauge steel into a 90° angle, measuring 1.375" wide and 2.0" in height, with a horizontal portion 48 and a vertical portion 49. In one embodiment, the horizontal portion 48 may include three, 0.5" long tabs with two recesses between. The vertical portion 49 may include contain a slot 51 and two through holes 52. In one preferred embodiment, the slot 51 may measure 0.156"×0.75" and each through hole 52 may measure 0.156" in diameter.

In accordance with aspects of the present disclosure, an example assembly to a listed and labeled fire rated door may include using an L-shaped bracket (e.g., the L-shaped bracket 17 described above in connection with FIGS. 7A and 7B) to attach to the bottom portion of a listed and labeled fire rated door for controlling or managing door bottom clearance purposes. To illustrate the option of using an L-shaped door bracket, the installation instruction for both a listed and labeled fire rated wood door and hollow metal, steel door are explained below.

Among other features, an example method of attachment for listed and labeled fire rated wood doors without using an L-shaped bracket is as follows:

1. Open the package and identify the proper mounting hardware (#10×2" screws).
2. Lay the removed door on a horizontal surface such as a work table or saw horses.
3. Place a component (e.g., the channel assembly 11 described above) onto the bottom of the door, holding flush at one edge and measuring any gap (if any) on the other edge.
4. Check the width of the component and trim to width, up to 2" per side, as necessary.
5. With the component at the appropriate width, center across the bottom of the door. Hold in this position and transfer the hole locations from the moveable portion of the component, onto the door bottom.
6. Remove the component and drill a 7/64" pilot hole 2" deep.
7. Ensure the faces of the door and door bottom are clean and free from debris.
8. install the #10×2" screws into the holes, leaving approximately ¼" of the screw out of the door bottom.
9. Install the component by placing the large diameter holes over the head of the screw and sliding the component (along the slot in the channel that attaches to the door bottom) until the head of the screw is visible through the hole in the moveable portion of the component (same holes used in earlier step to transfer hole location onto door bottom).
10. Ensure the component is positioned (side-to-side) between the edges of the door at the desired location, and then drive the #10×2" screws until the disclosed assembly is tight against bottom of the door.
11. Set the undercut position so that bottom of the component is ⅜" above the finished floor, using the end cap plates. Place a shim of the desired thickness under the floating portion of the component. Install the two tabs of the end cap plates under the formed channel of the moveable portion of the component. Hold in this position and secure the end cap plates to the edge of the door using the #6×¾" screws.

In accordance with aspects of the present disclosure, another example method of attachment for listed and labeled fire-rated hollow metal, steel doors using an L-shaped bracket (e.g., the L-shaped bracket 17 described above in connection with FIGS. 7A and 7B) is as follows:

1. Open the package and identify the proper mounting hardware (#8-32 thru-bolts and #6 TEK screws).
2. Open the door with excessive gap at the bottom for access to the full door width.
3. Slide a component (e.g., the channel assembly 11 described above) onto the bottom of the door, holding flush at one edge and measuring any gap (if any) on the other edge.
4. Check the width of the component and door bracket, and trim to width up to 2" per side, as necessary.
5. Assemble the door bracket to the component using the #6 TEK screws and the holes provided in the door bracket. Take caution to locate the screws to not interfere with the spring within the component.
6. With the component and door bracket assembled and at the appropriate width, center across the face of the door. Hold in this position and transfer the hole locations in the door channel onto the face of the door.
7. Remove the component and door bracket and drill a 7/32" diameter hole through the door.
8. Ensure the faces of the door are clean and free from any debris.
9. Assemble the component and door bracket to the door using the #8-32 through bolts.
10. Set the undercut position so that bottom of component is ⅜" above the finished floor, using the end cap plates. Place a shim of the desired thickness under the floating portion of the component. Install the two tabs of the end cap plates under the formed channel of the moveable portion of the component. Hold in this position and secure the end cap plates to the edge of the door using the #6×¾" screws.

Among other features, the present disclosure may achieve the following objectives:

Correct a non-compliant, excessive gap condition between a door bottom and a finished floor.

Provide an excessive gap door bottom solution which can travel in the vertical direction to accommodate an uneven floor condition (varying height across the width of the floor), whereby the disclosure contains a fixed component attached to the door and an integrated component which may either be stationary or dynamic during the swinging operation (or travel) of the door.

Provide an excessive gap door bottom solution which does not contact either face of the door.

Provide an excessive gap door bottom solution which contacts a single face of the door.

Provide an excessive gap door bottom solution which may be set to a different dimension on one side of the door to the other, between the bottom of the disclosed components and the top surface of the finished floor, across the width of the door.

Provide an excessive gap door bottom solution which uses one or more end caps to establish the distance between the bottom of the disclosed components and the top surface of the finished floor.

The above description of the disclosure is provided to enable a person skilled in the art to make or use the disclosure. Various modifications to the disclosure will be readily apparent to those skilled in the art, and the common principles defined herein may be applied to other variations without departing from the spirit or scope of the disclosure. Further, the above description in connection with the drawings describes examples and does not represent the only examples that may be implemented or that are within the scope of the claims.

Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise. Thus, the disclosure is not to be limited to the examples and designs described herein but is to be accorded the widest scope consistent with the principles and novel features disclosed herein.

The invention claimed is:

1. An assembly for controlling and managing a door bottom clearance of a fire-rated door, the assembly comprising:

a first component installed on a bottom edge of the fire-rated door, wherein the first component comprises:

a first channel component for mounting onto the bottom edge of the fire-rated door, and a second channel component configured to be movable within the first channel component; and at least one cap component configured to adjust an initial position of the second channel component in relation to the first channel component at a side of the fire-rated door to a selected position, wherein the second channel component is movable within space between the selected position and the first channel component to temporarily accommodate uneven locations in a finished floor beneath the fire-rated door during a swing motion of the fire-rated door.

2. The assembly of claim 1, wherein the first component is configured to control a gap between the bottom edge of the fire-rated door and the finished floor beneath the fire-rated door by at least maintaining a distance between a bottom side of the second channel component and the finished floor in accordance with a selected distance.

3. The assembly of claim 1, wherein the first channel component has a top horizontal panel attached to the bottom edge of the fire-rated door, and two L-shaped side panels, wherein each L-shaped side panel includes a vertical leg and a horizontal leg, wherein corresponding horizontal legs of the two L-shaped side panels are co-planar and define an opening to receive the second channel component.

4. The assembly of claim 3, wherein the second channel component is configured to be movable between a fully compressed state and a fully extended state within the first channel component controlled by a spring.

5. The assembly of claim 4, wherein the second channel component has two horizontal portions extending at two sides, wherein the two horizontal portions are configured to rest on the corresponding horizontal legs of the two L-shaped side panels of the first channel component when the second channel component is in the fully extended state within the first channel component.

6. The assembly of claim 1, wherein the at least one cap component is generally L-shaped including a vertical portion installed on an edge side of the fire-rated door and at least one horizontal tab inserted into space between the first and second channel components and retain the second channel component at the selected position at the side of the fire-rated door.

7. The assembly of claim 1, further comprising an L-shaped bracket including a vertical panel installed onto a surface side of the fire-rated door and a horizontal panel installed onto the bottom edge of the fire-rated door, wherein the first channel component of the first component is installed onto a bottom side of the horizontal panel of the L-shaped bracket.

8. The assembly of claim 1, further comprising a spring configured to connect the first and second channel components.

9. A method for controlling and managing a door bottom clearance of a fire-rated door, the method comprising:

installing a first component on a bottom edge of the fire-rated door, wherein the first component comprises:

a first channel component for mounting onto the bottom edge of the fire-rated door, and a second channel component configured to be movable within the first channel component, and using at least one cap component to adjust an initial position of the second channel component in relation to the first channel component at a side of the fire-rated door to a selected position, wherein the second channel component is movable within space between the selected position and the first channel component to temporarily accommodate uneven locations in a finished floor beneath the fire-rated door during a swing motion of the fire-rated door.

10. The method of claim 9, further comprising controlling, via the first component, a gap between the bottom edge of the fire-rated door and the finished floor beneath the fire-rated door by at least maintaining a distance between a bottom side of the second channel component and the finished floor in accordance with a selected distance.

11. The method of claim 9, wherein the first channel component has a top horizontal panel attached to the bottom edge of the fire-rated door, and two L-shaped side panels, wherein each L-shaped side panel includes a vertical leg and a horizontal leg, wherein corresponding horizontal legs of the two L-shaped side panels are co-planar and define an opening to receive the second channel component.

12. The method of claim 11, wherein the second channel component is configured to be movable between a fully compressed state and a fully extended state within the first channel component controlled by a spring.

13. The method of claim 12, wherein the second channel component has two horizontal portions extending at two sides, wherein the two horizontal portions are configured to rest on the corresponding horizontal legs of the two L-shaped side panels of the first channel component when the second channel component is in the fully extended state within the first channel component.

14. The method of claim 9, wherein the at least one cap component is generally L-shaped including a vertical portion installed on an edge side of the fire-rated door and at least one horizontal tab inserted into space between the first and second channel components and retain the second channel component at the selected position at the side of the fire-rated door.

15. The method of claim 9, further comprising:

installing an L-shaped bracket onto the bottom edge of the fire-rated door by installing a vertical panel of the L-shaped bracket onto a surface side of the fire-rated door and installing a horizontal panel of the L-shaped bracket onto the bottom edge of the fire-rated door; and installing the first channel component of the first component onto a bottom side of the horizontal panel of the L-shaped bracket.

16. The method of claim 9, wherein the first component further comprises a spring configured to connect the first and second channel components.

* * * * *